US010034523B2

(12) United States Patent
Lowery

(10) Patent No.: US 10,034,523 B2
(45) Date of Patent: Jul. 31, 2018

(54) UMBRELLA ASSEMBLY FOR SKI PYLON MOUNT

(71) Applicant: David A. Lowery, Knoxville, TN (US)

(72) Inventor: David A. Lowery, Knoxville, TN (US)

( * ) Notice: Subject to any disclaimer, the term of this patent is extended or adjusted under 35 U.S.C. 154(b) by 0 days.

(21) Appl. No.: 15/288,712

(22) Filed: Oct. 7, 2016

(65) Prior Publication Data

US 2018/0098605 A1 Apr. 12, 2018

(51) Int. Cl.

| | |
|---|---|
| ***A45B 11/00*** | (2006.01) |
| ***B63B 17/02*** | (2006.01) |
| ***E04H 12/22*** | (2006.01) |
| ***F16M 13/02*** | (2006.01) |
| ***A45B 23/00*** | (2006.01) |
| ***A45B 25/02*** | (2006.01) |
| ***A45B 3/00*** | (2006.01) |

(52) U.S. Cl.

CPC ..... *A45B 11/00* (2013.01); *A45B 3/00* (2013.01); *A45B 23/00* (2013.01); *A45B 25/02* (2013.01); *B63B 17/02* (2013.01); *E04H 12/22* (2013.01); *F16M 13/02* (2013.01)

(58) Field of Classification Search

CPC ..... A45B 23/00; A45B 11/00; A45B 3/00; A45B 25/14; A45B 2200/1009; B63B 17/02; B63B 17/04; B63B 7/085; B63B 2035/738; F16M 13/02; F16M 11/041; E04H 12/22

USPC ..... 135/16, 98, 155, 25.41; 116/173; 114/361–364, 242, 253, 343; 248/518–519, 540–541, 218.4, 229.15, 248/227.3, 230.1, 230.6, 231.71, 346.03

See application file for complete search history.

(56) References Cited

U.S. PATENT DOCUMENTS

| | | | | | |
|---|---|---|---|---|---|
| 2,559,421 | A | | 7/1951 | Garrett | |
| 2,618,285 | A | | 11/1952 | Heisig | |
| 2,634,740 | A | | 4/1953 | Duke | |
| 2,769,451 | A | | 11/1956 | Edgin | |
| 3,568,963 | A | | 3/1971 | Koskinen | |
| 4,086,931 | A | | 5/1978 | Hall | |
| 4,622,987 | A | * | 11/1986 | Redl | A45B 17/00 135/20.3 |
| 4,789,200 | A | | 12/1988 | Munguia | |
| 4,927,117 | A | * | 5/1990 | Gainey | A45B 11/00 135/88.01 |
| 4,977,848 | A | * | 12/1990 | Currey | B63B 29/04 114/363 |
| 5,076,185 | A | | 12/1991 | Tarng | |
| 5,255,954 | A | | 10/1993 | Rogers | |
| 5,354,031 | A | | 10/1994 | Bilotti | |
| 5,441,066 | A | | 8/1995 | Harris | |
| 5,495,821 | A | * | 3/1996 | Brewer | G09F 17/00 116/173 |
| 5,638,849 | A | | 6/1997 | Scott | |
| 5,662,306 | A | | 9/1997 | Dysarz | |
| 5,697,320 | A | | 12/1997 | Murray | |
| 5,836,327 | A | | 11/1998 | Davis | |

(Continued)

*Primary Examiner* — Winnie Yip

(74) *Attorney, Agent, or Firm* — Pitts & Lake, P.C.

(57) ABSTRACT

An assembly for mounting an umbrella proximate a mounting location for a ski pylon comprises an elongated member having a first end and an opposite second end. The first end defines features for securing the member first end to a ski pylon mount. The second end defining features for securing the member second end to a central shaft of an umbrella.

14 Claims, 8 Drawing Sheets

(56) References Cited

U.S. PATENT DOCUMENTS

| | | | | |
|---|---|---|---|---|
| 5,906,077 | A * | 5/1999 | Andiarena | E04H 12/2223 135/118 |
| 5,992,804 | A | 11/1999 | Johnson | |
| 6,039,061 | A | 3/2000 | Utley | |
| 6,045,109 | A * | 4/2000 | Mashburn | A01K 97/10 248/511 |
| 6,113,054 | A * | 9/2000 | Ma | E04H 12/2238 248/158 |
| 7,017,598 | B2 * | 3/2006 | Nipke | A45B 3/00 135/16 |
| 7,111,954 | B1 * | 9/2006 | Lai | A45B 3/04 362/102 |
| 7,201,442 | B1 | 4/2007 | Decosta, Jr. | |
| 7,357,094 | B2 * | 4/2008 | Burnley | B63B 17/02 114/361 |
| 7,395,775 | B2 * | 7/2008 | LaScala | B63B 17/02 114/361 |
| 7,540,561 | B2 | 6/2009 | McWhorter | |
| 8,096,310 | B2 | 1/2012 | Clarke | |
| 8,381,749 | B1 | 2/2013 | Ashmore, Jr. | |
| 9,060,613 | B2 | 6/2015 | Combs | |
| 9,194,152 | B1 | 11/2015 | Plasencia | |
| 2008/0029137 | A1 | 2/2008 | McInville | |
| 2013/0206193 | A1 * | 8/2013 | Browning | A45B 23/00 135/20.1 |
| 2016/0083048 | A1 * | 3/2016 | Munsch | B63B 17/02 248/539 |

* cited by examiner

UMBRELLA ASSEMBLY FOR SKI PYLON MOUNT

CROSS-REFERENCE TO RELATED APPLICATIONS

Not Applicable

STATEMENT REGARDING FEDERALLY-SPONSORED RESEARCH OR DEVELOPMENT

Not Applicable

BACKGROUND OF THE INVENTION

1. Field of Invention

The present general inventive concept relates to boat accessories, and, more particularly, to a portable umbrella assembly for mounting an umbrella for use on a boat.

2. Description of the Related Art

Shading and/or sheltering apparatus for use on a boat, such as for example above a seating area on a boat, are known in the art. Many boats have collapsible convertible tops that are permanently or semi-permanently mounted to the boat and permit a user to extend the top over a given area of the boat to provide shade and/or shelter beneath. Many such tops tend to be bulky, are not portable, are not easily deployed, and are unsightly when collapsed. Additionally, these tops, when collapsed, are often configured for storage along a rear transom area of the boat, which can interfere with other activities, such as for example water skiing and other surface water sports, or entry to or exit from the water via the rear transom area of the boat.

In the field of surface water sports, the use of a tow rope mounted near the transom area of a boat to tow a skier or other surface water sports participant behind the boat is known in the art. Many designs exist for accessory mounts for anchoring a tow rope near a transom area of a boat which allow the tow rope to swing freely over the transom without impedance by the boat's engines, cleats, or other items mounted near the transom area. For example, numerous designs exist for so-called "ski pylons," which comprise generally a post or pole mounted securely at one end to a central area of a boat, in front of the engine. The opposite end of the pylon extends upward and defines a connector to secure a tow rope thereto. Thus, the tow rope is maintained above the engine and rear transom area of the boat during use.

Ski pylons are typically mounted in a central area of a boat. In the case of a boat having seating surrounding the central area, the mounting location for a ski pylon often defines the central point of a desirable location for placement of a shading and/or sheltering apparatus. Accordingly, there is a need in the art for a shading and/or sheltering apparatus which is easily positionable and removable above a mounting location for a ski pylon in a boat.

BRIEF SUMMARY OF THE INVENTION

Various example embodiments of the present general inventive concept provide an umbrella assembly for a ski pylon mount which allows for the mounting of an umbrella and/or other shading and/or sheltering apparatus to a boat at a location of a ski pylon mount. The umbrella assembly for a ski pylon allows a user to quickly and conveniently position and mount an umbrella, such as for example a patio umbrella, securely above a mounting location for a ski pylon in a boat. Additionally, the assembly allows for quick and convenient removal and storage of the umbrella and assembly from the ski pylon mounting location, such that a user may quickly release an umbrella and umbrella assembly mounted above a mounting location for a ski pylon and conveniently store the umbrella and umbrella assembly.

Various example embodiments of the present general inventive concept may be achieved by providing an assembly for mounting an umbrella proximate a mounting location for a ski pylon. The assembly may comprise, in various embodiments, an elongated member having a first end and an opposite second end. The first end may define means for securing the member first end to a ski pylon mount, and the second end may define means for securing the member second end to a central shaft of an umbrella. In some embodiments, the means for securing the member first end to a ski pylon mount may comprise a shape defined by the member first end which is matable with internal portions of a ski pylon mount to engage and secure the ski pylon mount to the member first end. In some embodiments, the means for securing the member first end to a ski pylon mount may comprise an externally-threaded cylindrical shank protruding from an end surface of the member first end. In some embodiments, the member may a cylindrical shape which is coaxial with a central axis of the shank. In some embodiments, the shank may define an outer-thread diameter of approximately 1 inch, an inner-thread diameter of approximately ⅚ inch, and an axial length of approximately 1 inch.

In some embodiments, the means for securing the member second end to a central shaft of an umbrella may comprise a hollow, tubular shape defined by the member second end, the tubular shape being sized to receive therein a portion of a central pole of an umbrella. In some embodiments, the member second end may further define a necked-down end portion of the tubular shape, the necked-down end portion being sized to be received within a circular recess of a fitting disposed along the central pole of the umbrella, between the fitting and the central pole. In some embodiments, the member second end may further define a pair of through openings defined axially-inwardly of the necked-down end portion, each through opening being disposed on a diametrically opposite side of the member from the other through opening and in coaxial relationship to one another, each through opening being sized to receive a spring-loaded pin of the umbrella central pole.

In some embodiments, the member may have an outer diameter and length approximately equal to the respective outer diameter and length of a ski pylon. In some embodiments, the member may have an outer diameter of approximately 2½ inches.

Various additional example embodiments of the present general inventive concept may be achieved by providing an umbrella assembly for a boat. The umbrella assembly may, in various embodiments, comprise an umbrella having a central pole, a canopy comprising a plurality of ribs mounted for rotational movement in relation to the central pole and a webbing spanning between the ribs, and a fitting disposed along the central pole comprising controls for controlling rotation of the ribs. The fitting may define a circular recess surrounding a lower end of the central pole. The umbrella assembly may further comprise a member having a first end and an opposite second end, the first end being configured to be secured to the central pole, and a mount for securing the member second end to a surface of a boat, the mount comprising a housing defining a receptacle for receiving the member second end and a bracket for securing the housing to a surface of the boat. Thus, when the member first end is secured to the central pole, the member second end is received within the receptacle, and the housing is secured to the surface of the boat, the umbrella may extend above the mount.

In some embodiments, the housing receptacle of the mount may further be configured to receive a portion of a ski pylon to secure the ski pylon to the mount. In some embodiments, the member second end may define an externally-threaded cylindrical shank protruding from an end surface of the member second end. In some embodiments, the member may have a cylindrical shape which is coaxial with a central axis of the shank. In some embodiments, the shank may define an outer-thread diameter of approximately 1 inch, an inner-thread diameter of approximately ⅚ inch, and an axial length of approximately 1 inch.

In some embodiments, the member first end may define a hollow, tubular shape sized to receive therein the lower portion of the central pole. In some embodiments, the member first end may further define a necked-down end portion of the tubular shape, the necked-down end portion being sized to be received within the circular recess between the fitting and the central pole, wherein the remainder of the member first end defines a diameter greater than the diameter of the circular recess. In some embodiments, the member first end may further define a pair of through openings defined axially-inwardly of the necked-down end portion, each through opening being disposed on a diametrically opposite side of the member from the other through opening and in coaxial relationship to one another, each through opening being sized to receive a spring-loaded pin of the umbrella central pole. In some embodiments, the member may have an outer diameter and length approximately equal to the respective outer diameter and length of a ski pylon. In some embodiments, the member may have an outer diameter of approximately 2½ inches.

Additional aspects and advantages of the present general inventive concept will be set forth in part in the description which follows, and, in part, will be obvious from the description, or may be learned by practice of the present general inventive concept.

BRIEF DESCRIPTION OF THE SEVERAL VIEWS OF THE DRAWINGS

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION OF THE INVENTION

Reference will now be made to the example embodiments of the present general inventive concept, examples of which are illustrated in the accompanying drawings and illustrations. The example embodiments are described herein in order to explain the present general inventive concept by referring to the figures. The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Various example embodiments of the present general inventive concept provide an umbrella assembly for a ski pylon mount which allows for the mounting of an umbrella and/or other shading and/or sheltering apparatus to a boat at a location of a ski pylon mount. The umbrella assembly for a ski pylon, or "assembly," allows a user to quickly and conveniently position and mount an umbrella, such as for example a patio umbrella of the type known in the art, securely above a mounting location for a ski pylon in a boat.

Additionally, in various embodiments, the assembly allows for quick and convenient removal and storage of the umbrella and assembly from the ski pylon mounting location, such that a user may quickly release an umbrella and umbrella assembly mounted above a mounting location for a ski pylon and conveniently store the umbrella and umbrella assembly.

Figure 1:
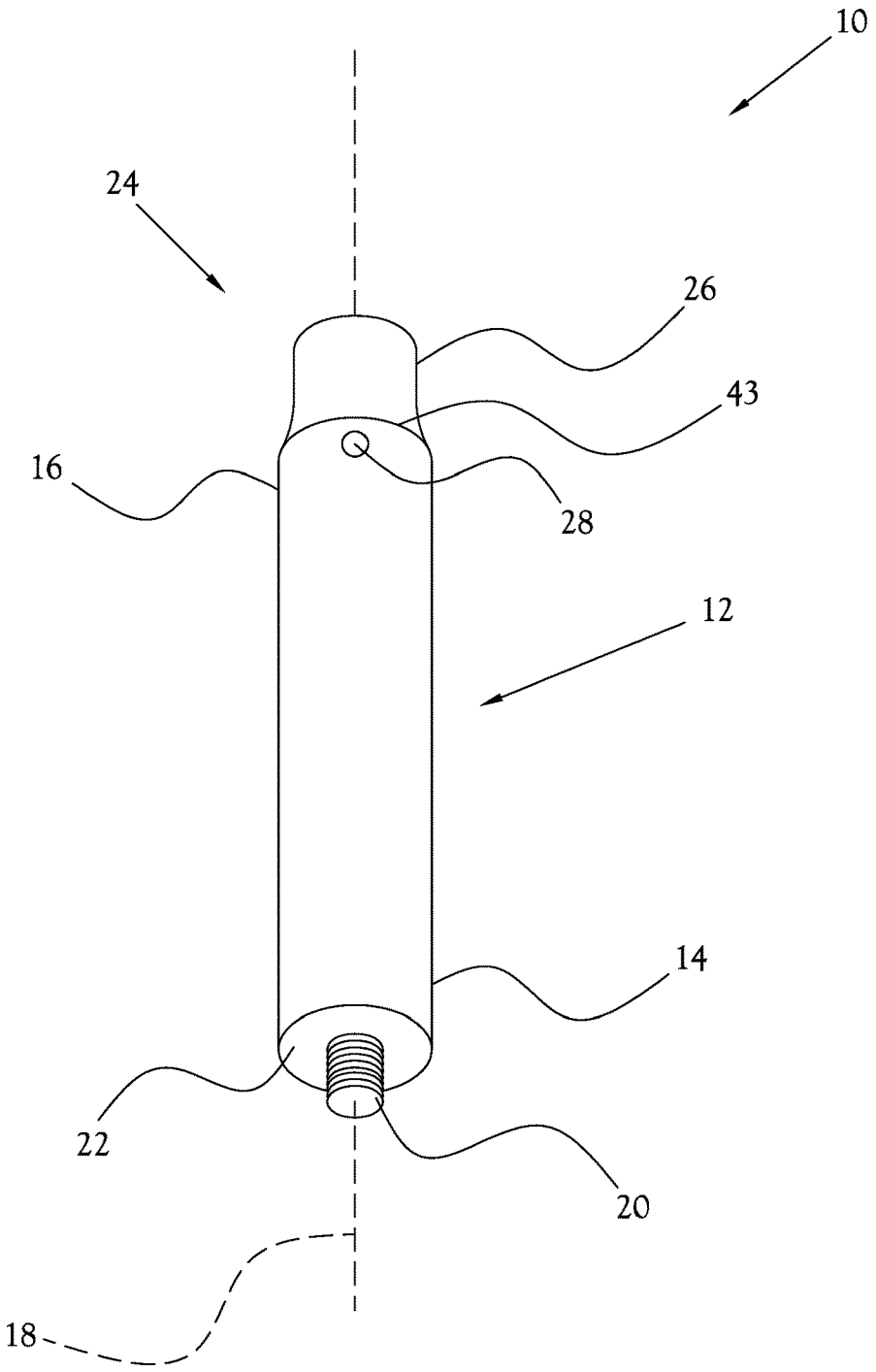
FIG. 1 is a perspective view showing one embodiment of an umbrella assembly for a ski pylon mount constructed in accordance with several features of the present general inventive concept.

One example embodiment of an assembly constructed in accordance with several features of the present general inventive concept is illustrated in FIG. 1. With reference to FIG. 1, in one embodiment, the assembly 10 includes a substantially elongated, cylindrical member 12 having a first end 14 and an opposite second end 16. As will further be discussed below, in various embodiments, the first end 14 of the member 12 defines one or more fasteners or other features suitable for securing the first end 14 to a mounting location for a ski pylon in a boat, such that the second end 16 extends generally above the mounting location. The second end 16 of the member 12 defines one or more additional fasteners or other features suitable for allowing an umbrella to be mounted thereto, such that a central axis 18 of the member 12 is positioned coaxial with a central axis of a central pole of the umbrella. In this manner, the umbrella is mounted for use with the central pole thereof extending generally above the member 12 and the mounting location for the ski pylon.

With further reference to FIG. 1, in the illustrated embodiment, the member 12 is configured for use in mounting a patio umbrella above a ski pylon mount of the type commonly manufactured and sold by Cobalt Marine, Inc. Accordingly, in the illustrated embodiment, the first end 14 of the member is sized and shaped to be received snugly within, and to conform to, an interior of a receptacle for a Cobalt® brand ski pylon mount. More specifically, in the illustrated embodiment, the first end 14 of the member 12 defines an outer diameter of approximately 2½ inches. An externally-threaded cylindrical shank 20 protrudes from an end surface 22 of the first end 14, coaxial with the central axis 18 of the member 12. In various embodiments, the shank 20 defines a size and shape suitable to allow for snug threaded engagement within a corresponding internally-threaded bore defined within the receptacle for the ski pylon mount. For example, in the illustrated embodiment, the shank 20 defines an outer-thread diameter of approximately 1 inch, an inner-thread diameter of approximately ⅝ inch, and an axial length of approximately 1 inch. However, those skilled in the art will recognize that other sizes, shapes, and configurations for the shank 20 may be used without departing from the spirit and scope of the present general inventive concept.

As noted above, in the illustrated embodiment, the member 12 is configured for use in mounting a patio umbrella above a ski pylon mount. Accordingly, in the illustrated embodiment, the second end 16 of the member is shaped and configured to engage a central pole of a patio umbrella, such that the central pole may be mounted in coaxial alignment with, and extending above, the member 12. More specifically, in the illustrated embodiment, the second end 16 defines a hollow, tubular portion 24 having a necked-down end portion 26 defining an outer diameter slightly less than the outer diameter of the remainder of the member 12. A pair of through openings 28 are defined slightly axially-inwardly of the necked-down end portion 26, with each through opening 28 being disposed on a diametrically opposite side of the member 12. The through openings 28 are further configured in a coaxial relationship to one another. Thus, the through openings 28 cooperate to define an open bore extending through the hollow, tubular portion of the second end 16 of the member 12, perpendicular to the central axis 18 of the member 12.

Figure 2:
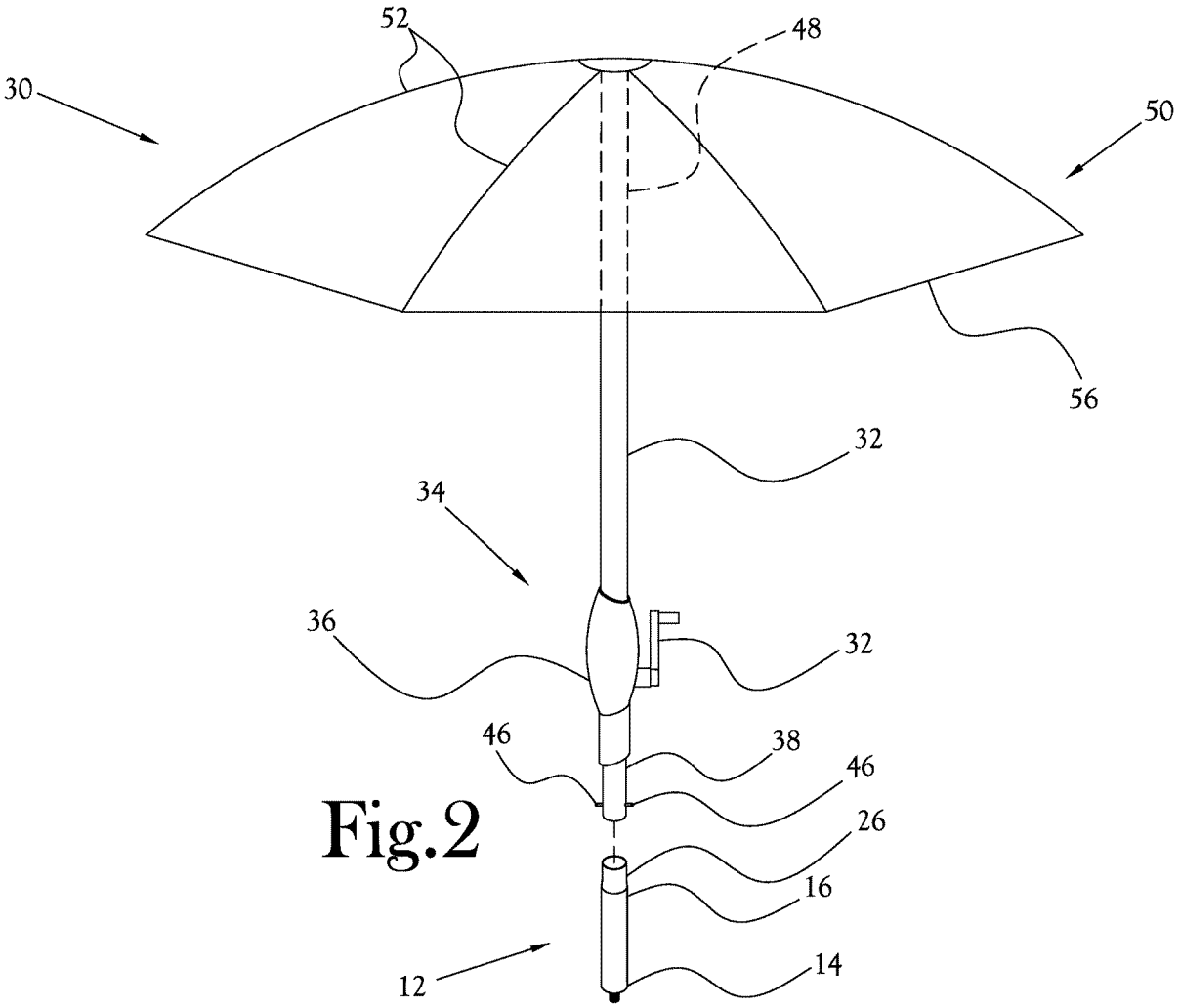
FIG. 2 is a perspective view showing the umbrella assembly of FIG. 1, together with an umbrella shown exploded therefrom.
Figure 3:
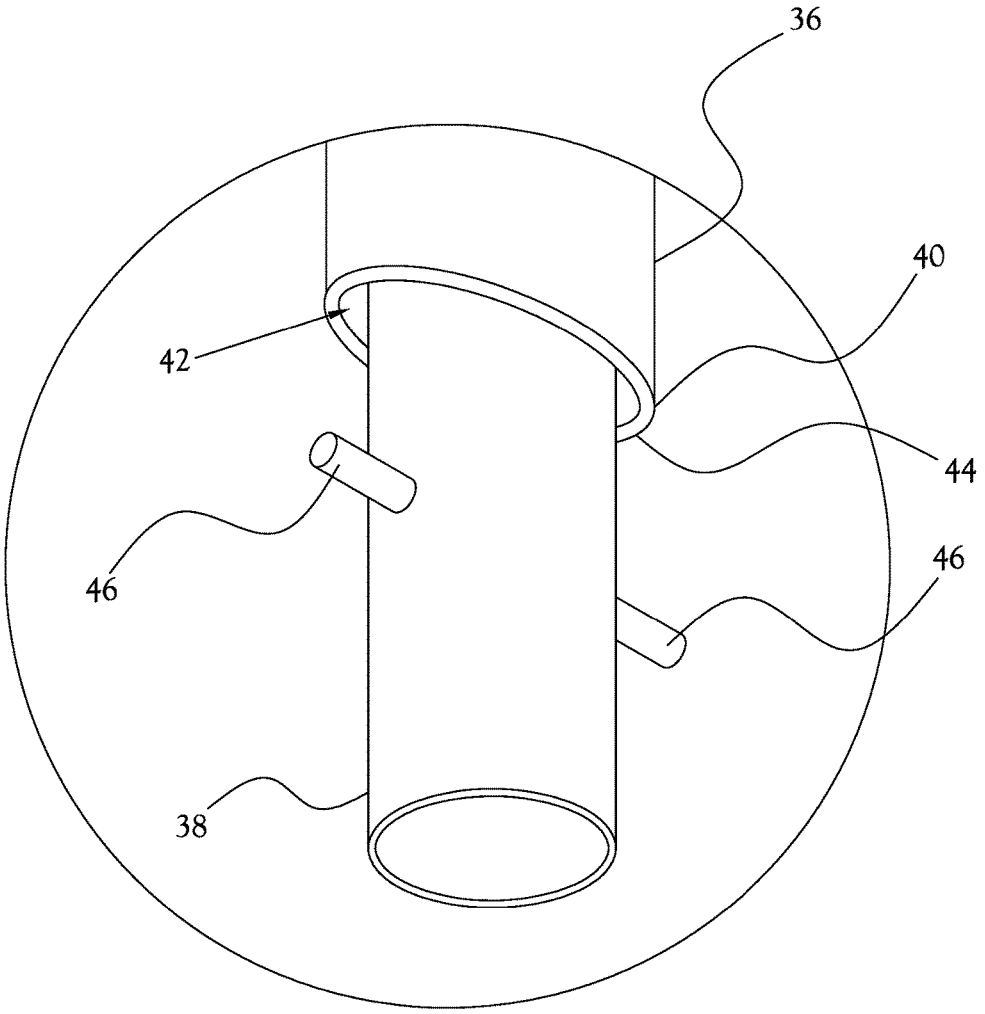
FIG. 3 is a partial perspective view showing the lower end of the umbrella of FIG. 2.

In FIG. 2, an umbrella 30 is shown having a central pole 32. A lower end 34 of the umbrella defines a fitting 36 which is disposed along a lower end 38 of the central pole 32 and is configured to cooperate with the central pole lower end 38 to engage the second end 16 of the member 12 to fix the central pole 32 in coaxial alignment with the member 12. A close-up view of the fitting 36 and central pole lower end 38 is illustrated in FIG. 3. With reference to FIGS. 2 and 3, in the illustrated embodiment, a lower surface 40 of the fitting 36 defines a circular recess 42 which extends generally upward from the fitting lower surface 40 coaxially with the central pole 32. The circular recess 42 is sized to allow receipt therein of the necked-down end portion 26 of the member second end 16, but to disallow receipt therein of the remainder of the member 12. Stated differently, when the necked-down end portion 26 of the member second end 16 is fully-received within the circular recess 42, a lower edge 44 of the circular recess 42 engages the interface 43 between the necked-down end portion 26 and the remainder of the member second end 16, thus preventing further insertion of the member second end 16 into the circular recess 42.

In the illustrated embodiment, the lower end 38 of the central pole 32 is oriented coaxially with the circular recess 42 of the fitting 36 and extends axially-outward, i.e., downward, from the lower surface 40 of the fitting 36. Thus, when the necked-down end portion 26 of the member second end 16 is fully-received within the circular recess 42, the lower end 38 of the central pole 32 is received within the hollow tubular portion of the second end 16 of the member 12. In the illustrated embodiment, a pair of spring-loaded, retractable pins 46 are disposed on diametrically opposite sides of the central pole lower end 38, extending generally outwardly from the central axis of the central pole 32. The pins 46 are positioned a distance along the length of the central pole lower end 38 such that, when the necked-down end portion 26 of the member second end 16 is fully-received within the circular recess 42 such that the lower edge 44 of the circular recess 42 engages the interface between the necked-down end portion 26 and the remainder of the member second end 16, the central pole 32 may be rotated in relation to the member 12 to align each spring-loaded pin 46 with a respective one of the through openings 28 defined in the member second end 16. Thus, each pin 46 may be received through a respective one of the through openings 28 of the member second end 16, thereby further securing the central pole 32 in axial alignment with the member 12 and limiting withdrawal of the necked-down end portion 26 of the member second end 16 from within the circular recess 42.

Numerous additional features of the umbrella 30 are illustrated in FIG. 2 and will be recognized by one of skill in the art. For example, in the illustrated embodiment, a canopy 50 is secured at an upper end 48 of the central pole 32. The canopy 50 includes a plurality of ribs 52, each of which is hingedly attached to the central pole 32 and is configured to rotate between a closed position, in which the rib extends generally along the central pole 32, and an open position, in which the rib extends more toward a perpendicular orientation in relation to the central pole 32. A winch 54 is carried by the fitting 36 and is in mechanical engagement with the various ribs 52 through suitable mechanical linkages (not shown), such that the winch 54 may be turned in order to reposition the ribs 52 collectively between their open and closed positions. A fabric webbing 56 spans between the various ribs 52, such that when the ribs 52 are in the open position, the webbing 56 provides a shelter over the area surrounding the central pole 32.

Figure 4:
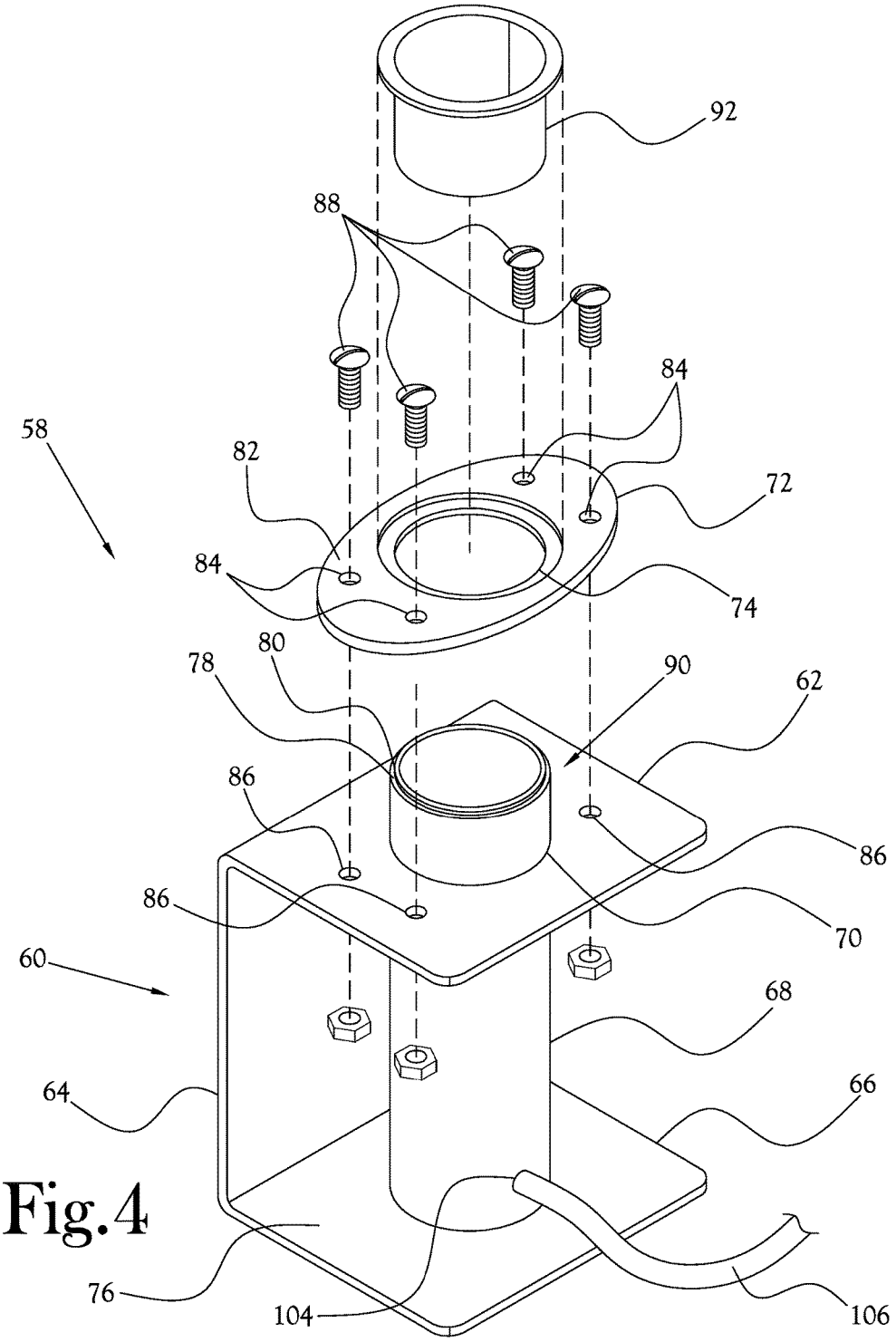
FIG. 4 is an exploded perspective view showing one embodiment of a ski pylon mount constructed in accordance with several features of the present general inventive concept.

FIG. 4 illustrates one embodiment of a ski pylon mount 58 which may be used to accomplish various embodiments of the assembly 10 in accordance with the present general inventive concept. In the embodiment of FIG. 4, a bracket 60 is provided defining generally an upper mounting plate 62 and a lower support plate 66, the two plates 62, 66 being fixed in relation to one another in generally overlying, spaced apart configuration, with each plate 62, 66 extending in respective, generally horizontal planes. In the illustrated embodiment, a rear plate 64 is provided fixed to, and extending vertically between, respective rear edges of the upper mounting plate 62 and the lower support plate 66, such that the rear plate 64 maintains the upper mounting plate 62 and lower support plate 66 in a fixed, rigid, spaced-apart overlying relationship to one another.

A cylindrical housing 68 is mounted to an upper surface 76 of the lower support plate 66. The cylindrical housing 68 extends upwardly through an opening 70 defined in the upper mounting plate 62 and terminates slightly upward thereof. In the illustrated embodiment, a cover plate 72 is provided defining a generally oval outer perimeter shape and a central circular through bore 74. The through bore 74 is sized to receive and engage an outer circumferential groove 78 defined along an upper edge of the cylindrical housing 68, such that the upper edge of the housing 68 may be received through the through bore 74. Once so configured, an upper surface 80 of the housing 68 terminates flush with an upper surface 82 of the cover plate 72, and the cover plate 72 limits further insertion of the housing 68 through the through bore 74.

In the illustrated embodiment, a plurality of through openings 84 are defined in the cover plate 72 about the through bore 74. For each through opening 84 in the cover plate 72, a corresponding and underlying through bore 86 is defined in the upper mounting plate 62 of the bracket 60. A plurality of fasteners, such as the illustrated nut and bolt assemblies 88, are provided, with each fastener being received through one of the corresponding pairs of through bores 74, 86 of the cover plate 72 and upper mounting plate 62. Thus, the cover plate 72 and upper mounting plate 62 cooperate to define a mounting clamp for mounting the ski pylon mount 58 to a suitable support surface, such as for example a table top, a seat portion of a bench or chair, or the like.

Figure 5:
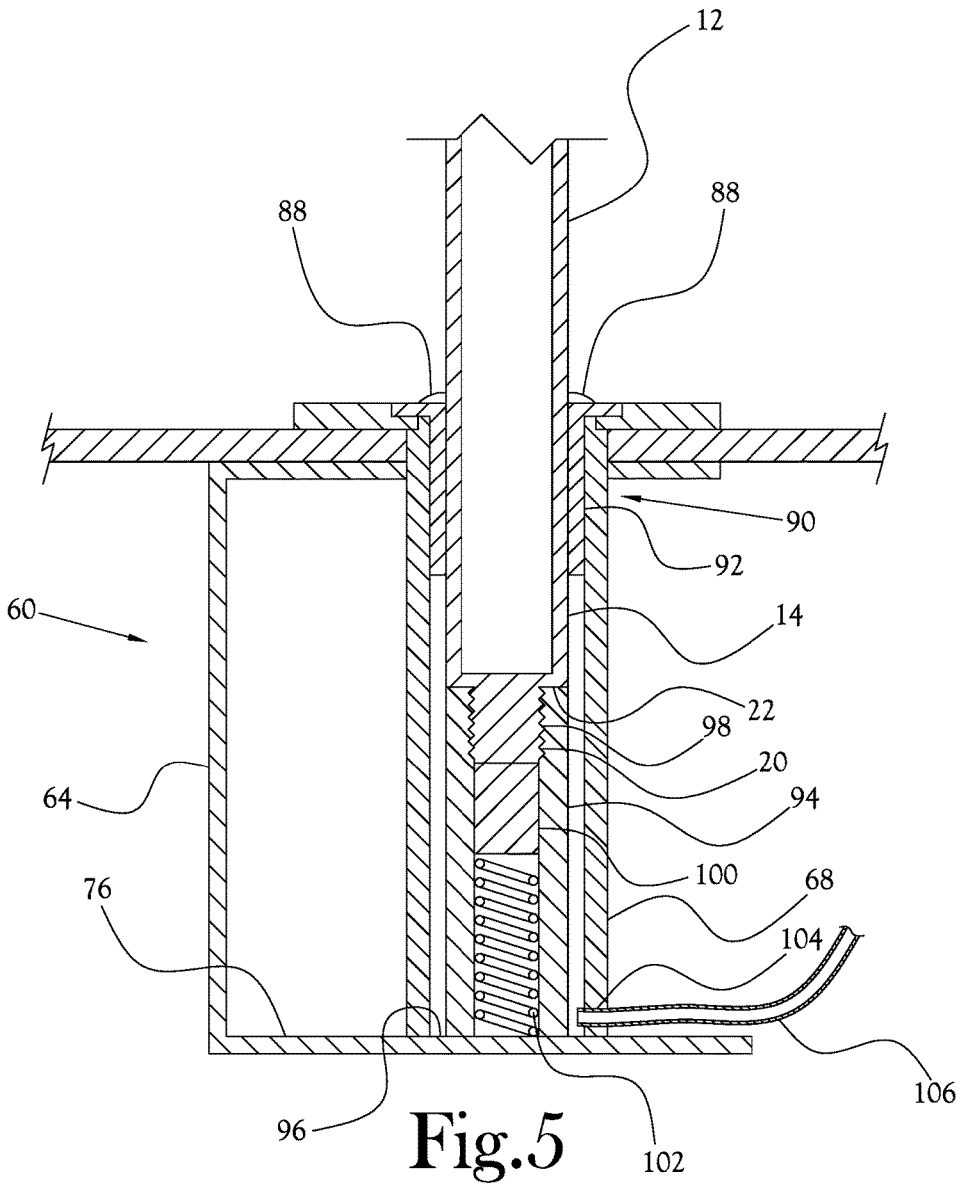
FIG. 5 is a cross-sectional side view showing the ski pylon mount of FIG. 4 assembled with the umbrella assembly of FIG. 1.

Referring now to FIGS. 4 and 5, in one embodiment, the cylindrical housing 68 includes an open upper end 90 having an annular bushing 92 received therein. The bushing 92 defines a circular upper opening of the housing 68 having a size and shape corresponding to the outer diameter of the member 12. Thus, when the member first end 14 is received within the circular upper opening of the housing 68, the bushing 92 maintains the member 12 in relatively snug engagement coaxially along a central axis of the housing 68. In the illustrated embodiment, a cylindrical pedestal 94 is disposed centrally within the housing 68, extending from a base surface 96 of the housing interior upward along the central axis of the housing 68. The pedestal 94 defines an upper surface sized and shaped to mate with and engage the end surface 22 of the member first end 14, and an internally-threaded central bore 98 sized and shaped to threadably mate with and engage the externally-threaded cylindrical shank 20 of the member first end 14.

In the illustrated embodiment, a plug 100 is disposed along the internally-threaded central bore 98. The plug 100 is sized to conform nicely to the interior diameter of the central bore 98 and is slidable along the central bore 98 between an upper position, in which an upper surface of the plug 100 is maintained flush with the upper surface of the pedestal 94, and an infinite number of lower positions within the central bore 98. In the illustrated embodiment, a spring 102 is provided between the plug 100 and the base surface 96 of the housing interior and is configured to bias the plug 100 toward the upper position. Thus, when the member 12 is not received within the housing 68 and the plug 100 is maintained in the upper position, the plug 100 discourages water, dust, and other debris from entering the central bore 98.

In the illustrated embodiment, a drain opening 104 is defined in the side wall of the housing 68 near the base surface 96. The drain opening 104 provides egress from the interior of the housing 68, such that water or other debris entering the housing interior may conveniently drain therefrom. In the illustrated embodiment, a hose 106 is secured to the drain opening 104 such that the hose 106 is in fluid communication with the housing interior.

Figure 6:
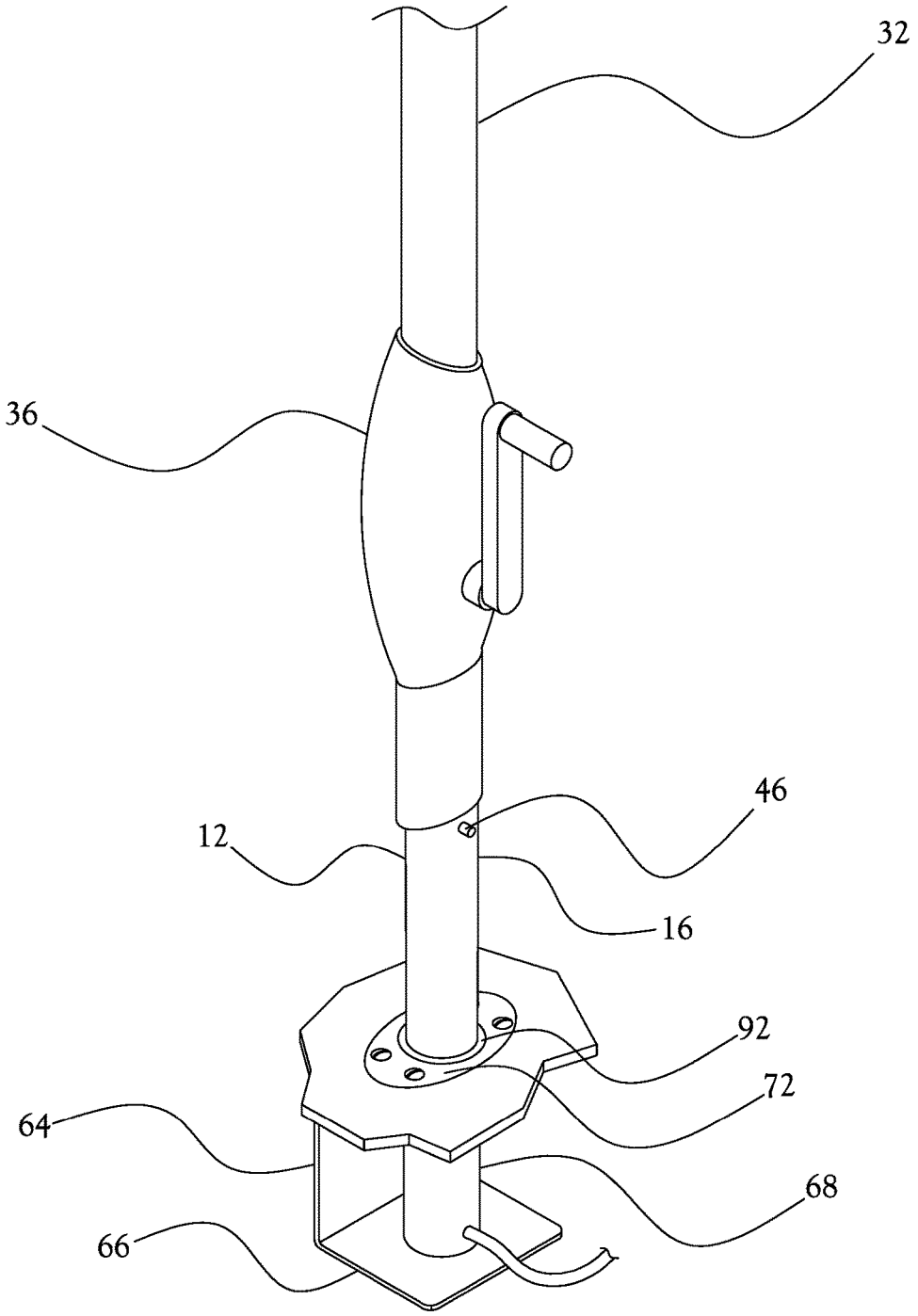
FIG. 6 is a partial perspective view showing the ski pylon mount and umbrella assembly of FIG. 5 assembled with the umbrella lower end of FIG. 3.

With reference to FIGS. 5 and 6, in operation, the first end 14 of the member 12 may be inserted into the upper opening of the housing 68 defined by the bushing 92, whereupon the externally-threaded cylindrical shank 20 of the member first end 14 may be pressed against the plug 100 to depress the plug 100 from the upper position thereof. Simultaneously, the member 12 may be rotated to threadably engage the shank 20 within the internally-threaded central bore 98, until the end surface 22 of the member first end 14 meets the upper surface of the pedestal 94, whereupon the bushing 92, the pedestal upper surface, and the threaded engagement of the shank 20 with the central bore 98 cooperate to secure the member 12 within the housing 68. The umbrella 30 may then be secured to the second end 16 of the member 12 as discussed above. Following use of the umbrella 30 as discussed above, the member 12 may be rotated to threadably disengage the shank 20 from the central bore 98, whereupon the member 12 may be removed from the housing 68. Upon removal of the shank 20 from the central bore 98, the plug 100 is allowed to return to the upper position.

Figure 7:
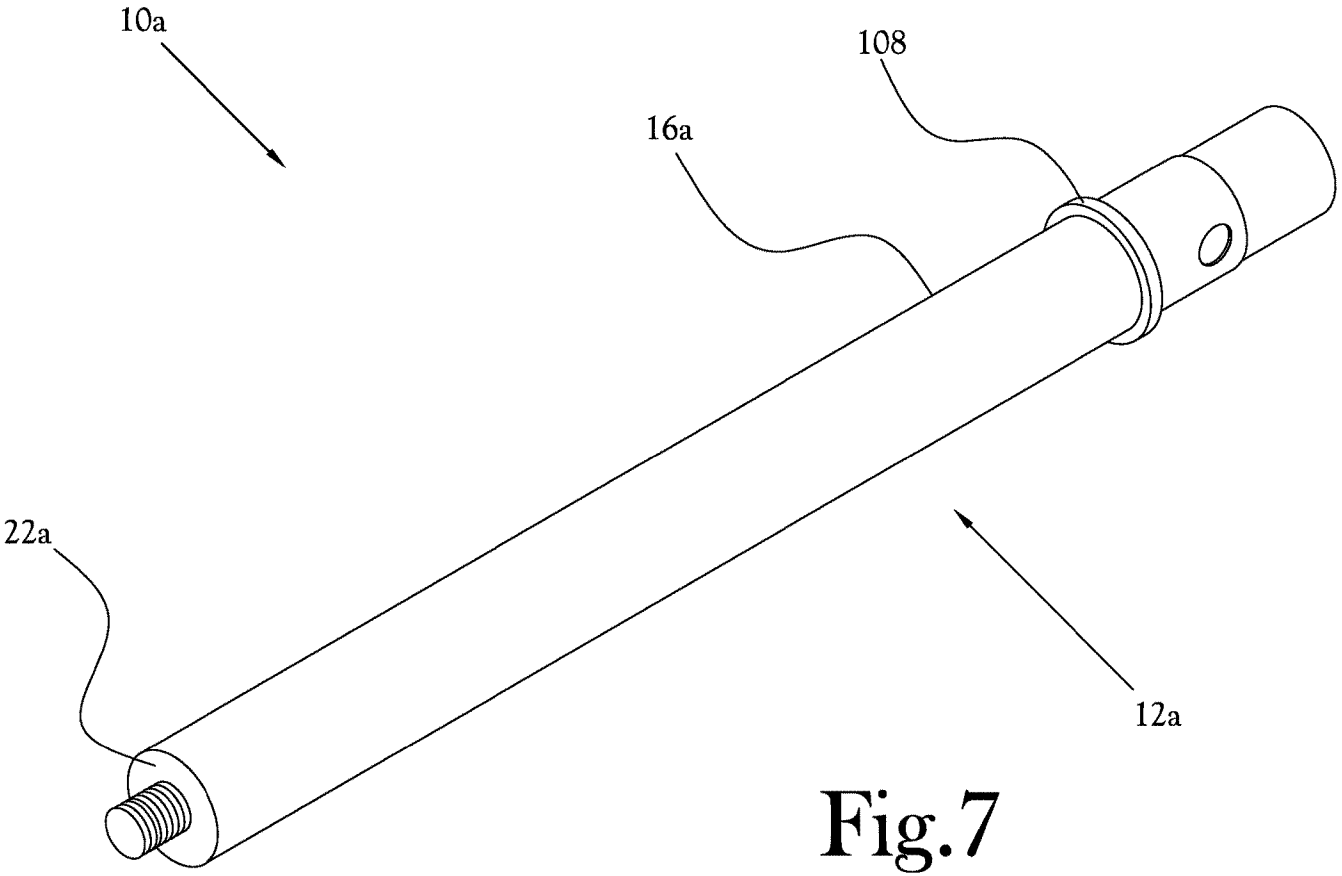
FIG. 7 is a perspective view showing another embodiment of an umbrella assembly for a ski pylon mount constructed in accordance with several features of the present general inventive concept.
Figure 8:
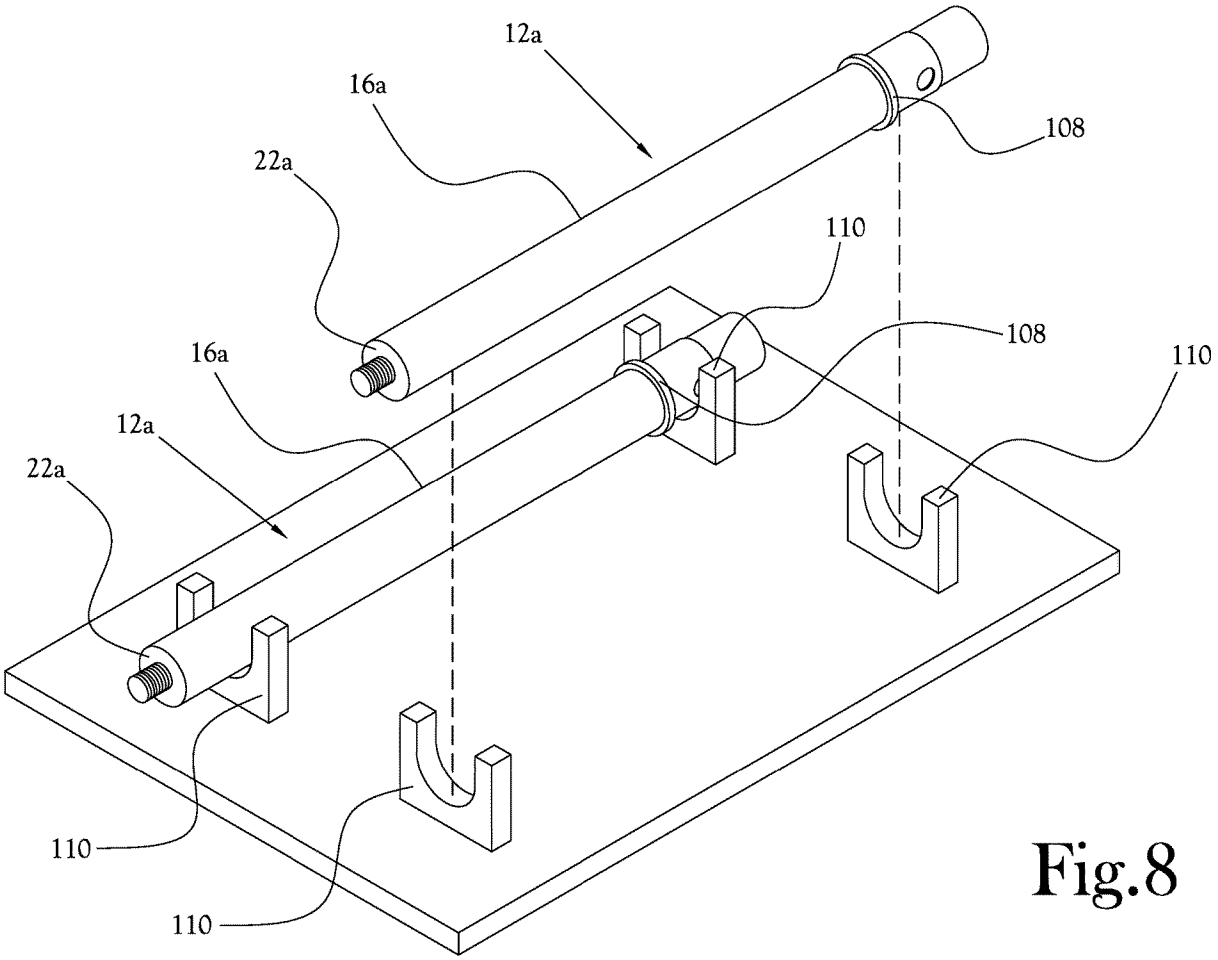
FIG. 8 is a partially exploded perspective view showing the umbrella assembly for a ski pylon mount of FIG. 7 mounted to a surface.

FIG. 7 illustrates another embodiment of an assembly **10*a* constructed in accordance with several features of the present general inventive concept. In the embodiment of FIG. 7, an annular retention lip 108 is provided extending radially outwardly about the circumference of the second end 16*a* of the member 12*a*, slightly axially inwardly from the through openings 28*a*. With reference to FIG. 8, in various embodiments, the member 12*a* of the assembly 10*a* is sized and shaped to be received within and engaged by a pair of clips 110, of the type commonly used to secure a ski pylon to an interior surface of a boat for storage of the ski pylon. Thus, the assembly 10*a* may be similarly received within and engaged by the pair of clips 110 for storage of the assembly 10*a* within the boat when not in use. In the illustrated embodiment, the retention lip 108 is disposed a suitable distance along the axial dimension of the member 12*a* such that, when the assembly 10*a* is received within and engaged by the pair of clips 110, the retention lip 108 abuts and engages one of the clips 110. Thus, the retention lip 108 serves to limit sliding movement of the assembly 10*a* along the axial dimension of the member 12*a* when the assembly 10*a* is received within and engaged by the pair of clips 110. Those of skill in the art will recognize that any number of retention lips 108 may be provided an a variety of configurations along the member 12*a* without departing from the spirit and scope of the present general inventive concept. For example, in another embodiment, a pair of retention lips 108 are provided, with each retention lip being positioned a suitable distance along the axial dimension of the member 12***a* such that, when the assembly 10*a* is received within and engaged by the pair of clips 110, each retention lip 108 abuts and engages a different one of the clips 110.

From the foregoing description, it will be recognized that an assembly is provided which allows for the removable mounting of an umbrella above a mounting location for a ski pylon in a boat. Numerous additional advantages of the present general inventive concept will be recognized by one of skill in the art. For example, it will be recognized that, in various embodiments, the member 12 forming the assembly 10 is of an approximately similar overall size and shape as a traditional ski pylon. Thus, in various embodiments, the member 12 may be stored and/or maintained using the same or accessories as are commonly provided for use with a ski pylon in a boat. For example, in various embodiments, the member 12 may be stored in a conventional rack, shelf, or box of the types used to store a traditional ski pylon. Those skilled in the art will recognize numerous additional advantages which may be realized through various embodiments of the present general inventive concept.

It is noted that, in the illustrated embodiments described herein, the simplified diagrams and drawings do not illustrate all the various connections and assemblies of the various components. However, those skilled in the art will understand how to implement such connections and assemblies, based on the illustrated components, figures, and descriptions provided herein, using sound engineering judgment. Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. An umbrella assembly for a boat, the umbrella assembly comprising:

an umbrella having a central pole, a canopy comprising a plurality of ribs mounted for rotational movement in relation to the central pole and a webbing spanning between the ribs, and a fitting disposed along the central pole comprising controls for controlling rotation of the ribs, the fitting defining a circular recess surrounding a lower end of the central pole;

a member having a first end and an opposite second end, the first end being configured to be secured to the central pole; and a mount for securing the member second end to a surface of a boat, the mount comprising:

a housing defining a receptacle having an open upper end for receiving the member second end;

a bracket fixed to and supporting the housing; and a plate defining a through opening surrounding the open upper end of the receptacle, the plate configured to engage the bracket to secure the open upper end of the housing flush along a surface of the boat;

whereby when said member first end is secured to the central pole, the member second end is received within the receptacle, and the housing is secured to the surface of the boat, the umbrella extends above the mount.

2. The umbrella assembly of claim 1, wherein the housing defines a drain opening at an end opposite the open upper end.

3. The umbrella assembly of claim 2, the member second end defining an externally-threaded cylindrical shank protruding from an end surface of the member second end.

4. The assembly of claim 3, the member having a cylindrical shape which is coaxial with a central axis of the shank.

5. The assembly of claim 4, wherein the shank defines an outer-thread diameter of approximately 1 inch, an inner-thread diameter of approximately ⅝ inch, and an axial length of approximately 1 inch.

6. The assembly of claim 5, the member first end defining a hollow, tubular shape sized to receive therein the lower portion of the central pole.

7. The assembly of claim 6, the member first end further defining a necked-down end portion of the tubular shape, the necked-down end portion being sized to be received within the circular recess between the fitting and the central pole, wherein the remainder of the member first end defines a diameter greater than the diameter of the circular recess.

8. The assembly of claim 7, the member first end further defining a pair of through openings defined axially-inwardly of the necked-down end portion, each through opening being disposed on a diametrically opposite side of the member from the other through opening and in coaxial relationship to one another, each through opening being sized to receive a spring-loaded pin of the umbrella central pole.

9. The assembly of claim 8, the member having an outer diameter and length approximately equal to the respective outer diameter and length of a ski pylon.

10. The assembly of claim 9, the member having an outer diameter of approximately 2½ inches.

11. The assembly of claim 4, the mount further comprising an annular bushing received within the open upper end of the receptacle, the bushing defining an upper opening corresponding to an outer shape of the member.

12. The assembly of claim 11, the mount further comprising a pedestal disposed centrally within the housing extending from a base surface of the receptacle interior upwardly, the pedestal having an upper surface sized and shaped to mate with and engage the second end of the member.

13. The assembly of claim 12, wherein the upper surface of the pedestal defines an internally-threaded central bore sized and shaped to threadably mate with and engage the externally-threaded cylindrical shank.

14. The assembly of claim 13, the mount further comprising a spring-loaded plug disposed along the internally-threaded central bore and biased toward an upper position in which an upper surface of the plug is maintained flush with the upper surface of the pedestal.

* * * * *